US008356699B2

(12) United States Patent
Räsänen et al.

(10) Patent No.: US 8,356,699 B2
(45) Date of Patent: Jan. 22, 2013

(54) ELEVATOR TOE GUARD

(75) Inventors: Matti Räsänen, Hyvinkaa (FI); Petri Pukkila, Hyvinkaa (FI); Timo Muukkonen, Hyvinkaa (FI)

(73) Assignee: Kone Corporation, Helsinki (FI)

( * ) Notice: Subject to any disclaimer, the term of this patent is extended or adjusted under 35 U.S.C. 154(b) by 869 days.

(21) Appl. No.: 12/487,062

(22) Filed: Jun. 18, 2009

(65) Prior Publication Data

US 2009/0277725 A1 Nov. 12, 2009

Related U.S. Application Data

(63) Continuation of application No. PCT/FI2007/000279, filed on Nov. 28, 2007.

(30) Foreign Application Priority Data

Dec. 19, 2006 (FI) ..... 20061138

(51) Int. Cl.

| | |
|---|---|
| ***B66B 13/28*** | (2006.01) |
| ***B66B 11/02*** | (2006.01) |
| ***B66B 1/28*** | (2006.01) |
| ***H01H 3/16*** | (2006.01) |

(52) U.S. Cl. ..... 187/400; 187/279; 187/401; 200/61.44

(58) Field of Classification Search ..... 187/400, 187/401, 307–310; 200/61.44; *B66B 13/28*
See application file for complete search history.

(56) References Cited

U.S. PATENT DOCUMENTS

| | | | | |
|---|---|---|---|---|
| 4,251,179 | A * | 2/1981 | Thorley | 414/545 |
| 4,302,145 | A * | 11/1981 | Heisler | 414/608 |
| 5,832,555 | A * | 11/1998 | Saucier et al. | 14/71.1 |

FOREIGN PATENT DOCUMENTS

| | | | |
|---|---|---|---|
| DE | 10115990 | C1 * | 10/2002 |
| EP | 1 215 159 | A2 | 6/2002 |
| EP | 1914190 | A1 * | 4/2008 |
| JP | 10017252 | A * | 1/1998 |
| WO | WO-02/10053 | A1 | 2/2002 |

* cited by examiner

*Primary Examiner* — Michael Mansen
*Assistant Examiner* — Stefan Kruer
(74) *Attorney, Agent, or Firm* — Birch, Stewart, Kolasch & Birch, LLP

(57) ABSTRACT

A toe guard (1) for an elevator car (2), said toe guard comprising a movable panel (3). The panel (3) comprises a first panel part (10) which, being guided and supported by guide tracks (5), is movable substantially between a drawn-out position on a landing floor and a stowed-away position under the car. In addition, the panel comprises a second panel part (11) which, guided by the first panel part (10), is telescopically movable between a retracted extreme position where the first and second panel parts are disposed in a mutually nested and/or superposed relationship, and an extended extreme position where the first and second panel parts are disposed substantially in a mutually adjacent relationship. When the toe guard is moved from the stowaway position into the operative position, it assumes steplessly a suitable length between the aforesaid retracted extreme position and the aforesaid extended extreme position, depending in each case on the height position (h) of the elevator car (2) having stopped between floors relative to the landing floor (6).

18 Claims, 3 Drawing Sheets

ELEVATOR TOE GUARD

Figure 1:
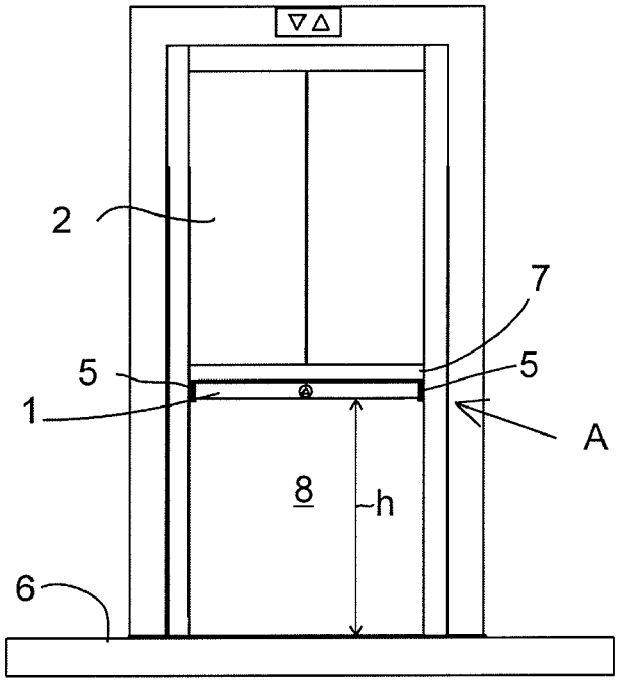

This application is a Continuation of PCT International Application No. PCT/FI2007/000279 filed on Nov. 28, 2007, and for which priority is claimed under 35 U.S.C. §120; and this application claims priority of Application No. 20061138 filed in Finland on Dec. 19, 2006 under 35 U.S.C. §119; the entire contents of all are hereby incorporated by reference into the present application.

FIELD OF THE INVENTION

The present invention relates to a toe guard as defined in the preamble of claim 1.

BACKGROUND OF THE INVENTION

In general, a toe guard (also called foot guard) is a safety device which is comprised in an elevator car and forms a wall extending downwards from the elevator car. When an elevator car stops between floors, there remains between the car and the landing floor a gap exposing the shaft. The toe guard is intended to cover this gap and thus to prevent a person escaping from the car onto the landing floor from falling into the shaft and/or to prevent any body part of the passenger from getting between the car and the landing floor. A toe guard suited for a small shaft bottom space is in itself very advantageous as it permits of a very low shaft bottom space. Shaft bottom space refers to the space remaining below an elevator car at the lowest stopping level.

For small shaft bottom spaces, specification EP 1 215 159 A2 discloses a toe guard for an elevator car, said toe guard comprising a movable panel provided with a locking device, and guide tracks mounted below the car in a substantially horizontal orientation. The panel, being guided and supported by the guide tracks, can be moved between a stowaway position and an operative position. In the stowaway position, the panel rests on the guide tracks in a substantially horizontal orientation, stowed away below the elevator car, where it can be locked in place by means of the locking device. In the operative position, the toe guard, supported by the guide tracks, is drawn out onto the landing floor and tilted to cover the gap between the car sill and the landing floor. In the operative position, the toe guard can be locked to the landing door jambs by means of the locking device, ensuring that the toe guard will not bend e.g. in consequence of a kick or other external exertion of force. The EP specification in question discloses a one-piece plate-like panel.

A problem with the above-mentioned prior-art bendable toe guard formed from a single panel part is that the panel in its operative position always has the same length and it can only be used to cover a gap of a certain size exposing the shaft between an elevator car and a landing floor, in a situation where the elevator car has stopped at a level between floors.

Further, telescoping toe guards consisting of two or more parts for small shaft bottom spaces are disclosed e.g. in specifications WO2005/121015 and FR2841886, but a typical feature of these toe guards is that they work on the shaft side and do not extend onto the landing floor and are not designed to be locked to the landing door jambs.

OBJECT OF THE INVENTION

The object of the invention is to overcome the above-mentioned drawbacks.

A specific object of the invention is to disclose an improved toe guard whose length is variable according to need.

BRIEF DESCRIPTION OF THE INVENTION

The toe guard of the invention is characterized by what is disclosed in the characterizing part of claim 1. Other embodiments of the invention are characterized by what is disclosed in the other claims. Inventive embodiments are also presented in the description part and drawings of the present application. The inventive content disclosed in the application can also be defined in other ways than is done in the claims below. The inventive content may also consist of several separate inventions, especially if the invention is considered in the light of explicit or implicit sub-tasks or with respect to advantages or sets of advantages achieved. In this case, some of the attributes contained in the claims below may be superfluous from the point of view of separate inventive concepts. The features of different embodiments of the invention can be applied in connection with other embodiments within the scope of the basic inventive concept.

According to the invention, the panel forming the toe guard comprises a first panel part, which, guided by guide tracks, is movable substantially between a position where it is drawn out onto a landing floor and a position where it is stowed away under the car, and a second panel part which, guided by the first panel part, is telescopically movable between a retracted extreme position where the first and second panel parts are disposed in a mutually nested and/or superposed relationship and an extended extreme position where the first and second panel parts are disposed substantially in a mutually adjacent relationship. When the toe guard is being moved from the stowaway position into the operative position, it assumes steplessly a suitable length between the aforesaid retracted extreme position and the aforesaid extended extreme position, depending in each case on the height position of the elevator car having stopped between floors relative to the landing floor level.

In an embodiment of the toe guard, the toe guard has been adapted to allow its use when the distance between the car and the landing floor is of the order of about 50 mm at a minimum and about 1 m at a maximum.

In an embodiment of the toe guard, the elevator comprises a safety circuit that prevents the elevator from moving in an error situation. The toe guard comprises a sensor connected to the safety circuit. The sensor is arranged to detect an error situation where the toe guard is not in the stowaway position. Safety circuit refers to a control circuit or a part of it that contains safety connections and contacts in series with the control coils of those contactors the opening of whose contacts causes the elevator to stop.

In an embodiment of the toe guard, the second panel part has a first side edge and a second side edge extending parallel to the guide tracks. The locking device comprises a first locking bolt, which is arranged to be movable between a locking position, in which the bolt projects from the first side edge in a substantially perpendicular direction, and a releasing position with the bolt retracted into/onto/under the second panel part. A second locking bolt is arranged to be movable between a locking position, in which the bolt projects from the second side edge in a substantially perpendicular direction, and a releasing position with the bolt retracted into/onto/under the second panel part. In addition, the locking device comprises an actuating mechanism for moving the first locking bolt and the second locking bolt simultaneously between the locking position and the releasing position.

In an embodiment of the toe guard, the second panel part has a forward edge, which is the edge oriented towards the landing. The actuating mechanism comprises an axle pin which is mounted on the second panel part near its forward edge so as to be rotatable about an axis perpendicular to the plane of the second panel part, said axle pin comprising an engaging element whereby the axle pin can be gripped with a tool to rotate it. A turnplate is attached to the axle pin so as to be rotatable together with it. A first rod, at the first end of which is the first locking bolt, is pivotally joined at its second end to the turnplate at a distance from the axle pin. A second rod, at the first end of which is the second locking bolt, is pivotally joined at its second end to the turnplate at a distance from the axle pin on the opposite side relative to the pivotal joint of the second end of the first rod.

In an embodiment of the toe guard, the engaging element is a triangular notch adapted to be gripped with a triangular key.

In an embodiment of the toe guard, the actuating mechanism comprises a spring arranged to force the locking bolts towards the releasing position.

In an embodiment of the toe guard, the axle pin is disposed in about the middle region of the second panel part in the immediate vicinity of the forward edge.

In an embodiment of the toe guard, the first panel part comprises a rear edge, a third side edge with a pin fastened to it at a position near the rear edge, and a fourth side edge with a pin fastened to it at a position near the rear edge. The toe guard is arranged to be supported by a pair of supporting members, each one of which has a horizontal slot through which the pin is adapted to extend. These slots form the aforesaid guide tracks.

In an embodiment of the toe guard, the slot 31 has at its end near the car door sill a downward part, into which the pin falls when the first panel part is in the extended extreme position and which part together with the pin constitutes a hinge about which the toe guard is turnable into an angle relative to the horizontal.

In an embodiment of the toe guard, the first panel part is formed from sheet metal having a first edge bend at either side edge. The second panel part is formed from sheet metal having a second edge bend at either side edge, the second panel part being adapted to fit with a clearance in the space delimited by the first edge bends.

LIST OF FIGURES

Figure 2:
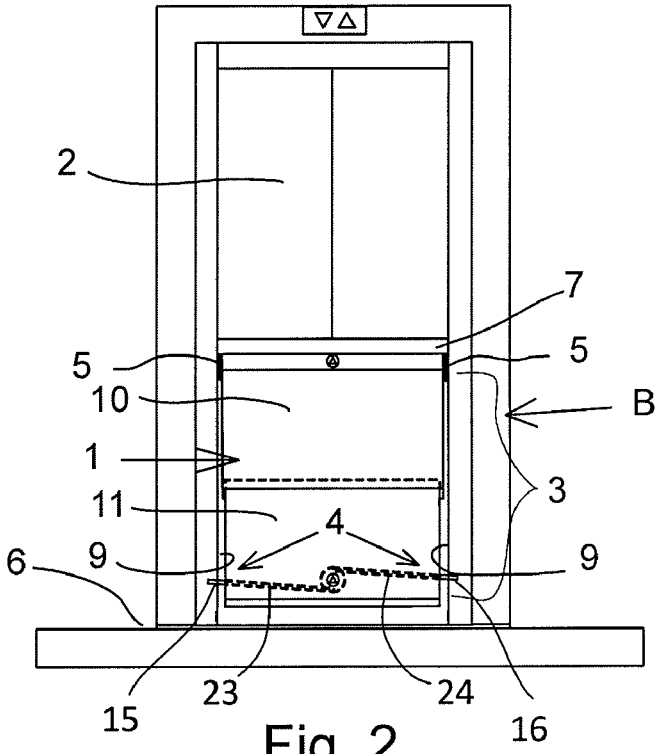
Figure 6:
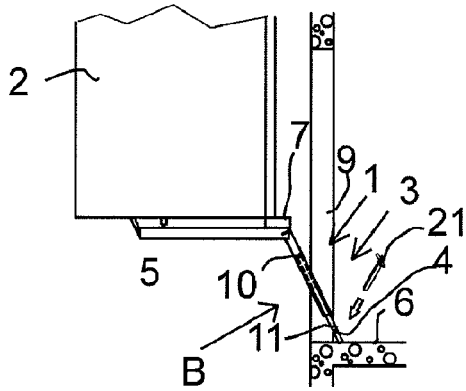
Figure 7:
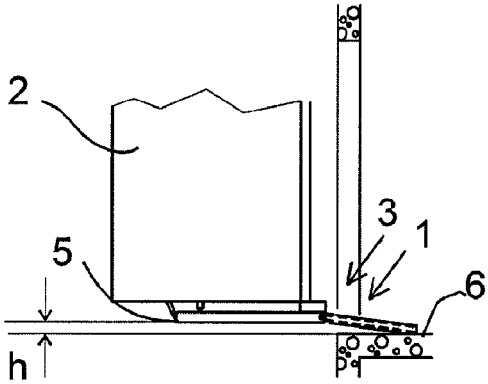
Figure 8:
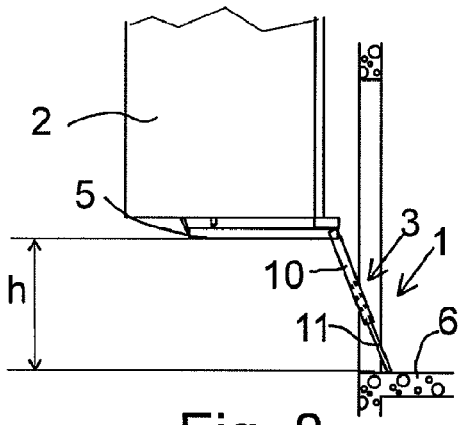
Figure 9:
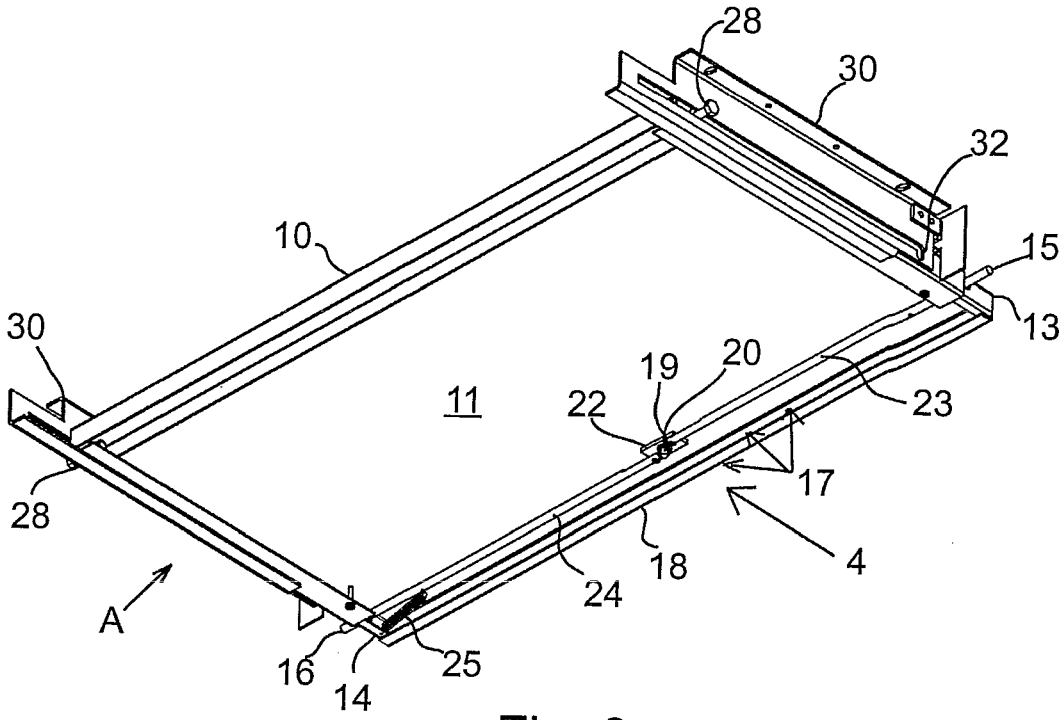
Figure 10:
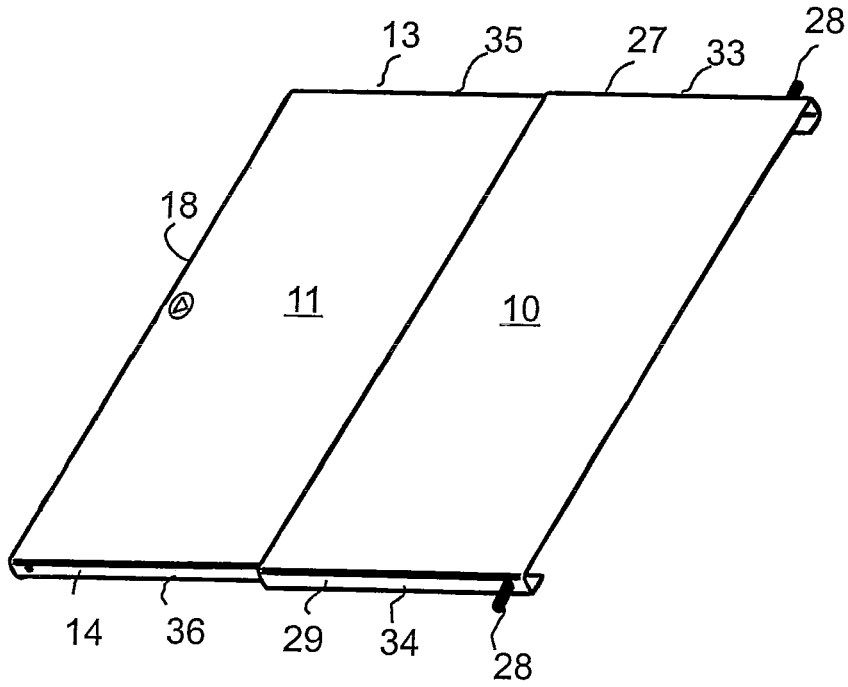

In the following, the invention will be described in detail by referring to embodiment examples and the attached drawing, wherein FIG. 1. is a diagram representing an elevator as seen from a landing, the elevator car being stuck between floors and provided with an embodiment of the toe guard of the invention, with the toe guard in stowaway position, FIG. 2 presents the elevator of FIG. 1 with the toe guard in operative position, FIGS. 3-6 are diagrammatic side views of the elevator in FIGS. 1 and 2, visualizing different stages when the toe guard is being moved from the stowaway position into the operative position, FIGS. 7 and 8, corresponding to FIG. 6, show the toe guard in operative position when the car is at different height levels relative to the landing, FIG. 9 is an axonometric representation of an embodiment of the toe guard of the invention as seen from below, and FIG. 10 is an axonometric representation of the first and second panel parts of the toe guard in FIG. 9 as seen in a drawn-out and spread-out position.

DETAILED DESCRIPTION OF THE INVENTION

FIGS. 1-6 show an elevator with its car 2 stuck between floors at distance h from a landing.

Figure 3:
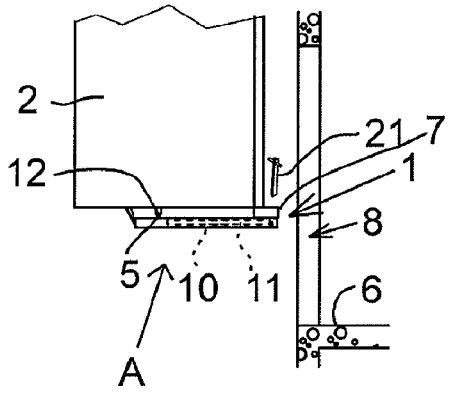
Figure 4:
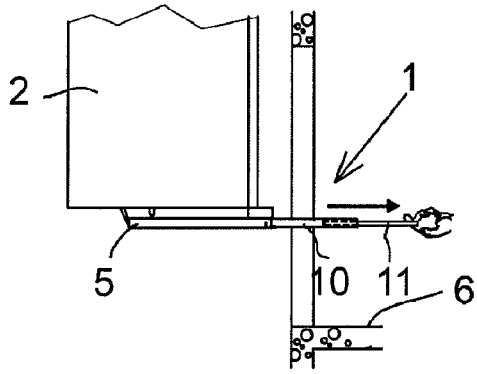
Figure 5:
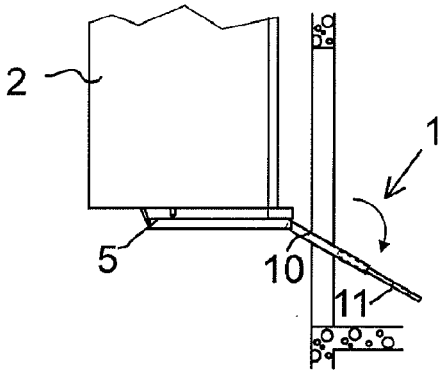

The car 2 is provided with horizontal guide tracks 5 secured under the floor of the car and a toe guard 1 is mounted to be supported by the guide tracks 5. In FIGS. 1 and 3, the toe guard is in a stowaway position A under the floor, in an orientation parallel to the guide tracks 5, so it takes up only a small space in the vertical direction. The toe guard 1 comprises a movable panel 3, which consists of two panel parts telescopically connected together, i.e. a first panel part 10 and a second panel part 11.

Being guided and supported by the guide tracks 5, the panel is movable between a stowaway position A and an operative position B, which are shown in FIGS. 1 and 3. In the stowaway position A, the panel parts 10 and 11 rest on the guide tracks in a substantially horizontal orientation under the car, where they can be locked in place by means of a locking device 4. In the operative position B shown in FIGS. 2 and 6, the toe guard 1, supported by the guide tracks 5, has been drawn out onto the landing floor 6 and tilted to cover the gap 8 between the car sill 7 and the landing floor 6. In the operative position, the toe guard 1 can be locked to the door jambs 9 of the landing door by means of the locking device 4.

The first panel part 10 can be moved along the guide tracks 5 between a drawn-out position, in which it is drawn out substantially onto the landing floor 6, and a stowed-away position under the car 2. The second panel part 11, being guided by the first panel part 10, is telescopically movable between a retracted extreme position and an extended extreme position. In the retracted extreme position, the first and second panel parts are disposed in a mutually nested and/or superposed relationship (FIG. 3). In the extended extreme position, the first and second panel parts are disposed substantially in a mutually adjacent relationship (see FIGS. 2, 6, 10). When the toe guard is moved from the stowaway position into the operative position, it assumes steplessly a suitable length between the aforesaid retracted extreme position and the aforesaid extended extreme position, depending in each case on the height position h of the elevator car having stopped between floors relative to the landing floor 6, as is also visualized in FIGS. 7 and 8.

The toe guard 1 has been adapted to permit its use when the distance h between the car 2 and the landing floor 6 is of the order of about 50 mm at a minimum and about 1 m at a maximum. Preferably the toe guard 1 is only used when the car remains at a maximum distance of 800 mm above the landing floor. If the car is at a distance exceeding 800 mm above the landing floor, then the car must first be lowered to the level of the landing floor before the passengers are allowed to get out of the car.

Referring to FIG. 3, the elevator comprises a safety circuit which prevents elevator movement in an error situation. The toe guard 1 comprises a sensor 12 connected to the safety circuit. The sensor has been arranged to detect an error situation where the toe guard 1 is not in the stowaway position A. The sensor 12 may be e.g. a limit switch which is turned on by the panel parts 10, 11 when locked in the stowaway position shown in FIG. 3.

The toe guard 1 is used as illustrated in FIGS. 3 and 6, by releasing the locking device 4 by means of a tool 21. The panel parts 10 and 11 are pulled horizontally along the guide tracks 5 onto the landing floor 6. Next, the panel parts 10 and 11 are tilted and the second panel part 11 is locked by means of the locking device 4 to the landing door jambs 9.

Referring to FIGS. 9 and 10, the locking device 4 comprises a first locking bolt 15, which is arranged to be movable between a locking position with the bolt projecting from the first side edge 13 of the second panel part 11 in a substantially perpendicular direction and a releasing position with the bolt retracted into/onto/under the second panel part 11. The locking device 4 further comprises a second locking bolt 16, which is arranged to be movable between a locking position with the bolt projecting from the second side edge 14 of the second panel part 11 in a substantially perpendicular direction and a releasing position with the bolt retracted into/onto/under the second panel part 11. Using the actuating mechanism 17, the first locking bolt 15 and the second locking bolt 16 can be moved simultaneously between the locking position and the releasing position. The actuating mechanism 17 comprises an axle pin 19 which is mounted on the second panel part 11 near its forward edge in about the middle region of the second panel part 11 so as to be rotatable about an axis perpendicular to the plane of the second panel part 11. The axle pin 19 comprises an engaging element 20 (e.g. a triangular notch) allowing the axle pin to be gripped with a tool 21 (e.g. a triangular key) to rotate it. A turnplate 22 is attached to the axle pin so as to be rotatable together with it. The first locking bolt 15 is at the first end of a first rod 23. The first rod 23 is pivotally joined at its second end to the turnplate at a distance from the axle pin 19. The second locking bolt 16 is at the first end of a second rod 24. The second rod 24 is pivotally joined at its second end to the turnplate 22 at a distance from the axle pin 19 on the opposite side relative to the pivotal joint of the second end of the first rod 23. The actuating mechanism 17 further comprises a spring 25 arranged to force the locking bolts 15, 16 towards the releasing position.

The first panel part 10 comprises a rear edge 26, a third side edge 27 with a pin 28 fastened to it at a position near the rear edge, and a fourth side edge 29 with a pin 28 fastened to it at a position near the rear edge. The toe guard 1 is arranged to be supported by a pair of supporting members 30. Each supporting member 30 has a horizontal slot 31, through which the pin is adapted to extend. The slots 31 form the aforesaid guide tracks 5.

At the end near the car door sill, the slot 31 has a downward part 32 into which the pin 28 falls when the first panel part 10 is in the drawn-out extreme position. The downward part 32 and the pin 28 together constitute a hinge about which the toe guard can be turned into an angle relative to the horizontal.

Referring to FIG. 10, the first panel part 10 is formed from sheet metal having a first edge bend 33, 34 at either side edge 27, 29. The second panel part 11 is formed from sheet metal having a second edge bend 35, 36 at either side edge 13, 14. The second panel part 11 is adapted to fit with a clearance in the space delimited by the first edge bends 33, 34.

It is obvious to a person skilled in the art that the invention is not limited to the embodiments described above, in which the invention has been described by way of example, but that many variations and different embodiments of the invention are possible within the scope of the inventive concept defined in the claims presented below.

The invention claimed is:

1. A toe guard for an elevator car, said toe guard comprising a movable panel provided with a locking device, and guide tracks mounted below the car in a substantially horizontal orientation, which panel, being guided and supported by said guide tracks, is movable between a stowaway position and an operative position, in which stowaway position the panel rests on the guide tracks in a substantially horizontal orientation under the car and lockable in place by the locking device, and in which operative position the toe guard, supported by the guide tracks, has been drawn out onto a landing floor and tilted to cover a gap between a car sill and the landing floor, and in which operative position the toe guard is lockable to a landing door jamb by the locking device, wherein the panel comprises:

a first panel part which, guided by the guide tracks, is movable substantially between a drawn-out position where the first panel part is drawn out onto the landing floor and a stowed-away position under the car, and a second panel part which, guided by the first panel part, is telescopically movable from the first panel part between a retracted extreme position with the first and second panel parts disposed in a nested or superposed relationship, and an extended extreme position with the first and second panel parts disposed substantially in a mutually adjacent relationship.

2. The toe guard according to claim 1, wherein the toe guard has been adapted to allow use when a distance (h) between the car and the landing floor is of the order of about 50 mm at a minimum and about 1 m at a maximum.

3. The toe guard according to claim 2, wherein the second panel part comprises a first side edge and a second side edge extending parallel to the guide tracks, and wherein the locking device comprises a first locking bolt, which is arranged to be movable between a locking position, in which the first locking bolt projects from the first side edge in a substantially perpendicular direction, and a releasing position with the first locking bolt retracted under the second panel part, a second locking bolt is arranged to be movable between a locking position, in which the second locking bolt projects from the second side edge in a substantially perpendicular direction, and a releasing position with the second locking bolt retracted under the second panel part, an actuating mechanism for moving the first locking bolt and the second locking bolt simultaneously between the locking position and the releasing position.

4. The toe guard according to claim 2, wherein the second panel part has a forward edge, which is the edge oriented towards the landing, and wherein an actuating mechanism comprises an axle pin, which is mounted on the second panel part near the forward edge so as to be rotatable about an axis perpendicular to a plane of the second panel part, said axle pin comprising an engaging element whereby the axle pin can be gripped with a tool to rotate the axle pin, a turnplate attached to the axle pin so as to be rotatable together with the axle pin, a first rod, at a first end of which is the first locking bolt, said first rod being pivotally joined at a second end of the first rod to the turnplate at a distance from the axle pin, and a second rod, at a first end of which is the second locking bolt, said second rod being pivotally joined at a second end of the second rod to the turnplate at a distance from the axle pin on opposite side relative to the pivotal joint of the second end of the first rod.

5. The toe guard according to claim 1, wherein the elevator comprises a safety circuit that prevents the elevator car from moving in an error situation, and wherein the toe guard comprises a sensor which is connected to the safety circuit and which is arranged to detect an error situation where the toe guard is not in the stowaway position.

6. The toe guard according to claim 5, wherein the second panel part comprises a first side edge and a second side edge extending parallel to the guide tracks, and wherein the locking device comprises a first locking bolt, which is arranged to be movable between a locking position, in which the first locking bolt projects from the first side edge in a substantially perpendicular direction, and a releasing position with the first locking bolt retracted under the second panel part, a second locking bolt is arranged to be movable between a locking position, in which the second locking bolt projects from the second side edge in a substantially perpendicular direction, and a releasing position with the second locking bolt retracted under the second panel part, an actuating mechanism for moving the first locking bolt and the second locking bolt simultaneously between the locking position and the releasing position.

7. The toe guard according to claim 5, wherein the second panel part has a forward edge, which is the edge oriented towards the landing, and wherein an actuating mechanism comprises an axle pin, which is mounted on the second panel part near the forward edge so as to be rotatable about an axis perpendicular to a plane of the second panel part, said axle pin comprising an engaging element whereby the axle pin can be gripped with a tool to rotate the axle pin, a turnplate attached to the axle pin so as to be rotatable together with the axle pin, a first rod, at a first end of which is the first locking bolt, said first rod being pivotally joined at a second end of the first rod to the turnplate at a distance from the axle pin, and a second rod, at a first end of which is the second locking bolt, said second rod being pivotally joined at a second end of the second rod to the turnplate at a distance from the axle pin on an opposite side relative to the pivotal joint of the second end of the first rod.

8. The toe guard according to claim 1, wherein the second panel part comprises a first side edge and a second side edge extending parallel to the guide tracks, and wherein the locking device comprises a first locking bolt, which is arranged to be movable between a locking position, in which the first locking bolt projects from the first side edge in a substantially perpendicular direction, and a releasing position with the first locking bolt retracted under the second panel part, a second locking bolt is arranged to be movable between a locking position, in which the second locking bolt projects from the second side edge in a substantially perpendicular direction, and a releasing position with the second locking bolt retracted under the second panel part, an actuating mechanism for moving the first locking bolt and the second locking bolt simultaneously between the locking position and the releasing position.

9. The toe guard according to claim 8, wherein the second panel part has a forward edge, which is the edge oriented towards the landing, and that the actuating mechanism comprises an axle pin, which is mounted on the second panel part near the forward edge so as to be rotatable about an axis perpendicular to a plane of the second panel part, said axle pin comprising an engaging element whereby the axle pin can be gripped with a tool to rotate the axle pin, a turnplate attached to the axle pin so as to be rotatable together with the axle pin, a first rod, at a first end of which is the first locking bolt, said first rod being pivotally joined at a second end of the first rod to the turnplate at a distance from the axle pin, and a second rod, at a first end of which is the second locking bolt, said second rod being pivotally joined at a second end of the second rod to the turnplate at a distance from the axle pin on the opposite side relative to the pivotal joint of the second end of the first rod.

10. The toe guard according to claim 9, wherein an engaging element is a triangular notch adapted to be engaged with a triangular key.

11. The toe guard according to claim 10, wherein the actuating mechanism comprises a spring arranged to force the locking bolts towards the releasing position.

12. The toe guard according to claim 10, wherein the axle pin is disposed in about a middle region of the second panel part in an immediate vicinity of the forward edge.

13. The toe guard according to claim 9, wherein the actuating mechanism comprises a spring arranged to force the locking bolts towards the releasing position.

14. The toe guard according to claim 13, wherein the axle pin is disposed in about a middle region of the second panel part in an immediate vicinity of the forward edge.

15. The toe guard according to claim 9, wherein the axle pin is disposed in about a middle region of the second panel part in an immediate vicinity of the forward edge.

16. The toe guard according to claim 1, wherein the first panel part comprises a rear edge, a third side edge with a pin fastened thereto at a position near the rear edge, and a fourth side edge with a pin fastened thereto at a position near the rear edge; and wherein the toe guard is arranged to be supported by a pair of supporting members, each one of said supporting members comprising a horizontal slot through which the pin is adapted to extend, said slots forming the aforesaid guide tracks.

17. The toe guard according to claim 16, wherein a slot has at its end near the car door sill a downward part, into which the pin falls when the first panel part is in the drawn-out position and which part together with the pin constitutes a hinge about which the toe guard is turnable into an angle relative to a horizontal plane.

18. The toe guard according to claim 1, wherein the first panel part is formed from sheet metal having a first edge bend at either side edge, and that the second panel part is formed from sheet metal having a second edge bend at either side edge, said second panel part being adapted to fit with a clearance in the space delimited by the first edge bends.

* * * * *